US007337572B2

(12) United States Patent
Corsaro et al.

(10) Patent No.: US 7,337,572 B2
(45) Date of Patent: Mar. 4, 2008

(54) INTEGRATED FIREARM SECURITY LOCK

(75) Inventors: Donald Frank Corsaro, Chardon, OH (US); Christopher Lee Fenn, Hudson, OH (US)

(73) Assignee: Donald F. Corsaro, Chardon, OH (US)

( * ) Notice: Subject to any disclaimer, the term of this patent is extended or adjusted under 35 U.S.C. 154(b) by 17 days.

(21) Appl. No.: 11/358,425

(22) Filed: Feb. 21, 2006

(65) Prior Publication Data

US 2007/0119087 A1 May 31, 2007

Related U.S. Application Data

(60) Provisional application No. 60/740,537, filed on Nov. 29, 2005.

(51) Int. Cl.
*F41A 17/00* (2006.01)

(52) U.S. Cl. ..... 42/70.01; 42/70.11; 42/70.08

(58) Field of Classification Search ..... 42/70.01, 42/70.08, 70.11; 70/295, 296, 301, 303 A, 70/308

See application file for complete search history.

(56) References Cited

U.S. PATENT DOCUMENTS 5,743,039 A * 4/1998 Garrett ..... 42/70.11

* cited by examiner

*Primary Examiner*—Michael J. Carone
*Assistant Examiner*—Gabriel J. Klein

(57) ABSTRACT

The difficulties and drawbacks of previous-type systems are overcome by the present invention which includes a locking device for a firing spring housing in a firearm. A main housing is provided including an internal cylindrical portion for receiving a firing spring. A lock rod is received in the main housing, for selectively engaging the firing spring. The lock rod is movable between an engagement position and a disengagement position with the firing spring. A combination disk is provided for engaging the lock rod, to selectively fix the lock rod in one of the engagement position and the disengagement position.

5 Claims, 6 Drawing Sheets

INTEGRATED FIREARM SECURITY LOCK

Supplemental cross reference Provisional Patent Application No. 60/740,537 filed on Nov. 29, 2005

BACKGROUND OF THE INVENTION

1. Field of the Invention

The present invention is directed generally to the field of firearm safety and security.

2. Description of Related Art

In the debate over gun control, partisans on both sides of the issue agree that handgun-related accidents are tragic, particularly where minors are injured or killed upon gaining access to an unsecured weapon. According to the advocacy group "Americans for Gun Safety" (AGS), over 40% of Americans are gun owners and that there are an estimated 250 million guns in the US today. AGS further noted in 2002 that an estimated 40,000 minors bring guns to school each year. In 2004, estimates by the Department of Justice indicated 475,000 non-fatal firearms-related incidents with the victimization rate in minors ages 12 years and older.

The actual annual number of accidental shootings is difficult to determine, but the above numbers clearly show the need for improvements in handgun safety. However, the currently available safeguards have proven to be inadequate. Typically, a firearm security lock is a separate device that is not an integrated part of the weapon. Such locks are typically externally attached to the firearm to render it inoperative.

One such security device is a "trigger lock." This device is typically formed into two halves. The trigger guard of the weapon is then placed between the two halves. The trigger lock is then closed and locked, typically with a key. The trigger of the weapon can no longer be accessed, preventing the use of the weapon. However, this device greatly limits the operability of the weapon, since it can be a time-consuming process to remove the trigger guard. Also, the key can be obtained by minors or other unauthorized persons, who can open the trigger lock and obtain use of the weapon.

Another type of security device is a "cable lock." This device renders the weapon inoperative by pushing a steel cable though the barrel and out the ejection port. The two ends are then locked together by a lock. This device is also a key-locked device, and suffers from the same deficiencies as the trigger lock.

SUMMARY OF THE INVENTION

The difficulties and drawbacks of previous-type systems are overcome by the present invention which includes a locking device for the firing spring in a firearm. A main housing is provided including an internal cylindrical portion for receiving a firing spring. A lock rod is received in the main housing, for selectively engaging the firing spring. The lock rod is movable between an engagement position and a disengagement position with the firing spring. A combination disk is provided for engaging the lock rod, to selectively fix the lock rod in one of the engagement position and the disengagement position.

The invention is intended to replace a firing spring component or components of the weapon. It will perform the original components functions and will also have the capability to disable the firearm by use of a combination or a keyed locking mechanism. The disabled firearm will not be able to fire a round, and the weapon can not be disassembled.

As will be realized, the presently disclosed embodiments are capable of other and different embodiments and its several details are capable of modifications in various respects, all without departing from the invention. Accordingly, the drawings and description are to be regarded as illustrative and not restrictive.

DETAILED DESCRIPTION OF THE INVENTION

Figure 1:
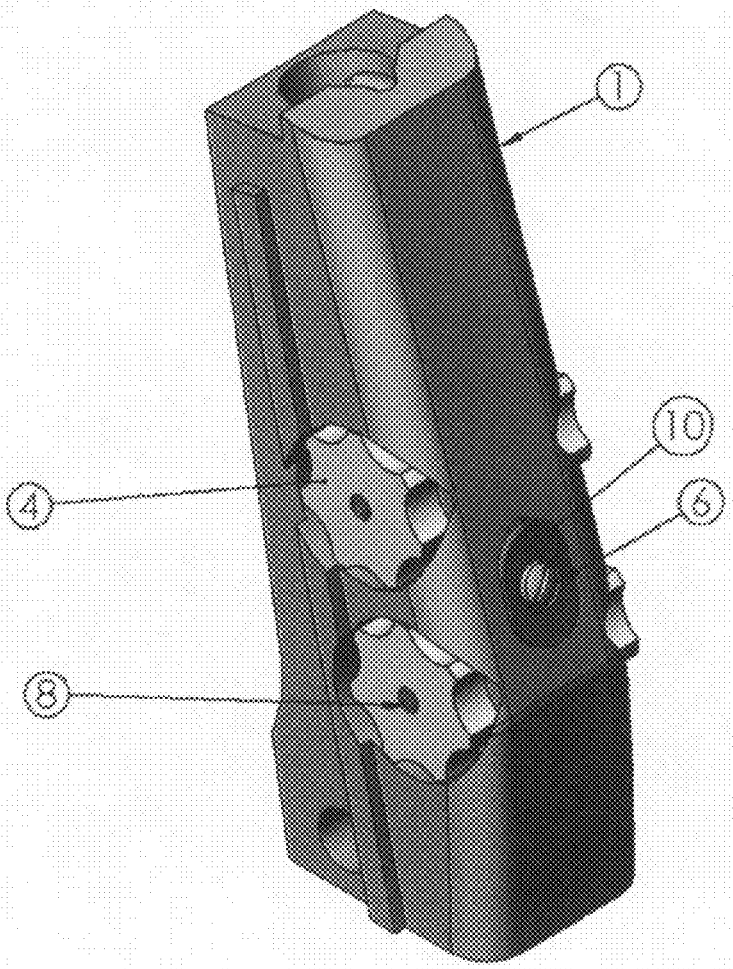
FIG. 1 is an assembled view of the locking device in accordance with a preferred embodiment of the present invention.

Reference is now made to the drawing figures, where it is understood that like reference numerals are drawn to like elements. Examples are described herein below of various embodiments of an integrated safety lock, preferably for use with a semi-automatic hand gun. The present invention can be a replacement component for use with an original equipment manufacturer (OEM) handgun. However, it can also be included with an OEM handgun or other firearm. It is appreciated that the present invention can be adapted to other applications as would be understood by persons having skill in the art, all without departing from the invention.

The present invention is used in a conventional-type weapon, e.g. an M1911 .45 caliber pistol. Such a weapon is loaded when a round (i.e. bullet) enters into the firing chamber. To enter the round, a slide is pulled back from a receiver allowing a magazine or clip that holds the rounds to push one upward into the firing chamber.

When the slide is pulled back it also pushes back the weapon's hammer and down on an armature (i.e. a mainspring cap) that engages a spring to a depressed position (where the spring is located in the main spring housing). Once the slide is returned to the closed position the round is considered "chambered" (i.e. ready to fire).

The hammer is held back in the firing position and the spring in the main spring housing is held in the depressed position. To fire the weapon, the trigger is pulled, releasing the hammer. The tension on the spring is then disengaged, which thrusts the mainspring cap upward and pushing the hammer forward, striking the firing pin. In turn, the firing pin strikes the round (bullet) allowing it to be discarded. The bullet recoil pushes the slide back and a new round enters the chamber, returning the slide to its closed position. If the trigger is pulled again the process repeats and continues.

FIG. 1 shows a replacement OEM main spring housing 1 in accordance with the present invention having a locking device built in. The main spring housing 1 is provided with one or more combination disks 4 having numbers on the outside edge, so that a combination can be rotatably dialed. In this illustrated embodiment, four combination disks 4 are shown, but it is appreciated that any suitable number of disks can also be used.

The disks 4 are rotated to select the correct sequence of numbers needed to release the locking device and allow the locking rod actuator 10 to slide from the locked to the unlocked positions. The locking rod actuator 10 slides freely as long as the combination disks have the correct sequence of numbers selected. Once the lock rod actuator 10 is in the locked or unlocked position the combination disks 4 are rotated to prevent undesired the movement of the lock rod actuator.

Figure 2A:
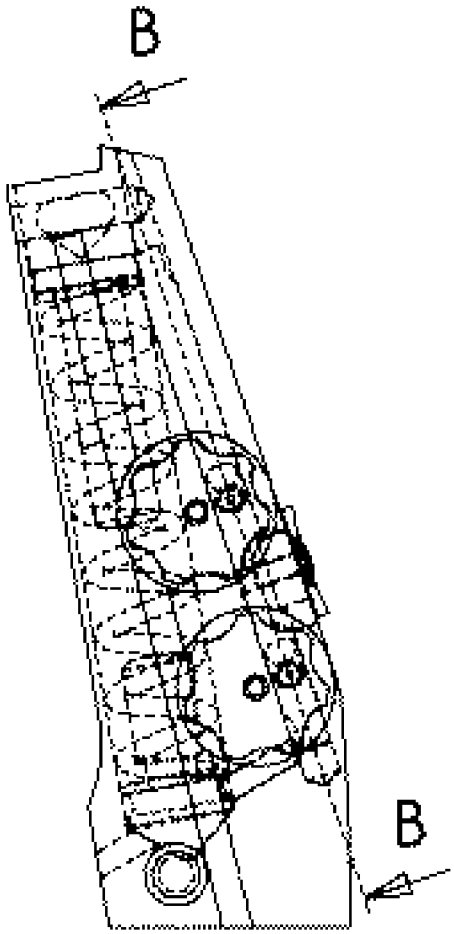
FIGS. 2A and 2B are respectively a side-detail view and a front-sectional view along line B-B showing the locking device in accordance with the preferred embodiment.
Figure 2B:
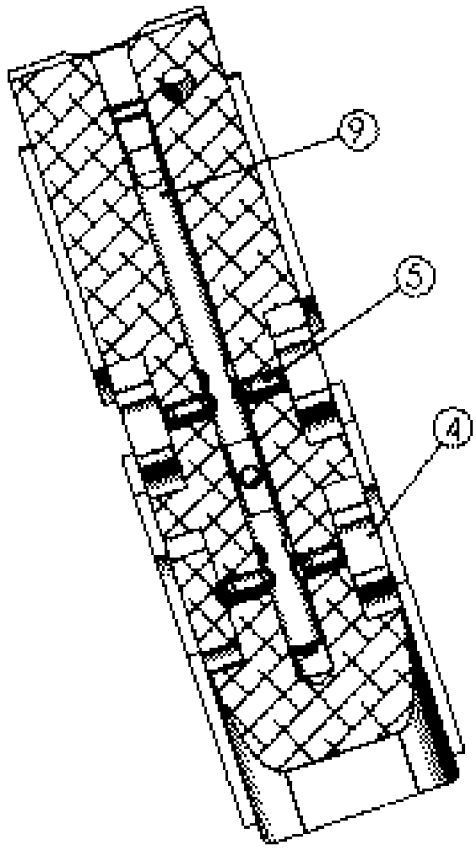

FIGS. 2A and 2B are sectional views that show the lock rod 9, which is attached to the lock rod actuator 10 by a screw 6 in the unlocked position. The lock rod 9 includes notches that each receive a proximal end of a disk pin 5. The disk pin 5 includes a proximal end and a distal end. The proximal end of each disk pin 5 is directed inward toward the center of the housing 1, for engagement with the notches of the lock rod 9. The distal end of each disk pin 5 is directed outward from the center of the housing 1 for engagement into a depression in the combination disks 4. The proximal and distal ends of the disk pin 5 are preferably rounded, so as to facilitate their motion into and out of the notches and also the depressions on the combination disks 4, as will be presently explained.

The proximal ends of the respective disk pins 5 engage a notch on the lock rod 9. A respective distal end of each disk pin 5 engages a corresponding depression on an interior surface of the combination disk 4. Engagement of the proximal end with the notch retains the lock pin, and engagement of the distal end with the depression allows movement of the proximal end out of the notches, releasing the lock pin.

When the combination disks 4 are turned to the correct sequence, a depression formed on the interior surface of the disk 4 is lined up to receive a protruding distal end of a disk pin 5. When all four disks 4 are in the proper alignment positions, the lock rod 9 can then moved up into the "locked" position or moved down to the "unlocked" position, which will allow the disk pins 5 to slide out of the notches in the lock rod 9 and into depressions formed in the combination disks 4.

As particularly seen in FIG. 2B, the lock pin 9 includes first and second notches to correspond to each disk pin 5. Engagement of the proximal end of each disk pin 5 with the first notch fixes the lock rod 9 in the unlocked position. When the lock rod 9 has been displaced, engagement in enabled between the second notch and the proximal end of the disk pin 5, thereby fixing the lock rod in the locked position.

Figure 3A:
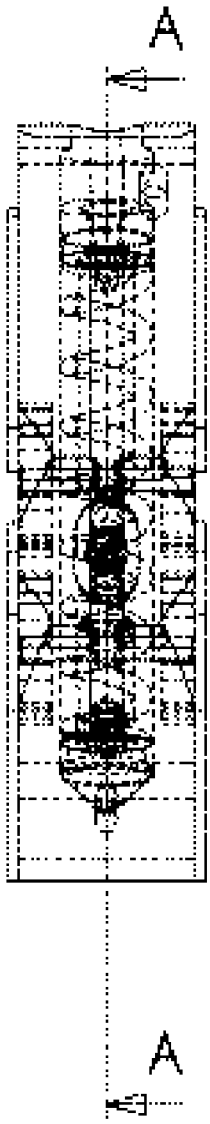
FIGS. 3A and 3B are respectively a front-detail view and a side-sectional view along line A-A showing the locking device (unlock position) in accordance with the preferred embodiment.
Figure 3B:
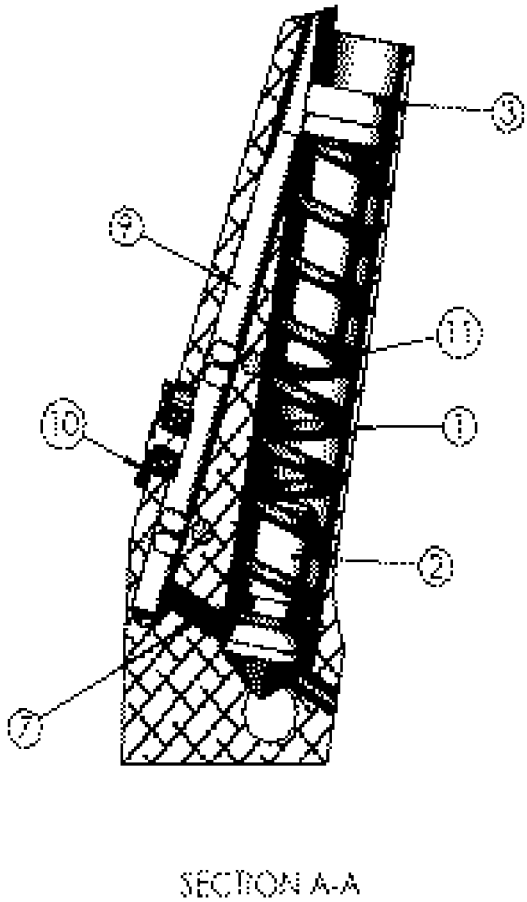
Figure 5:
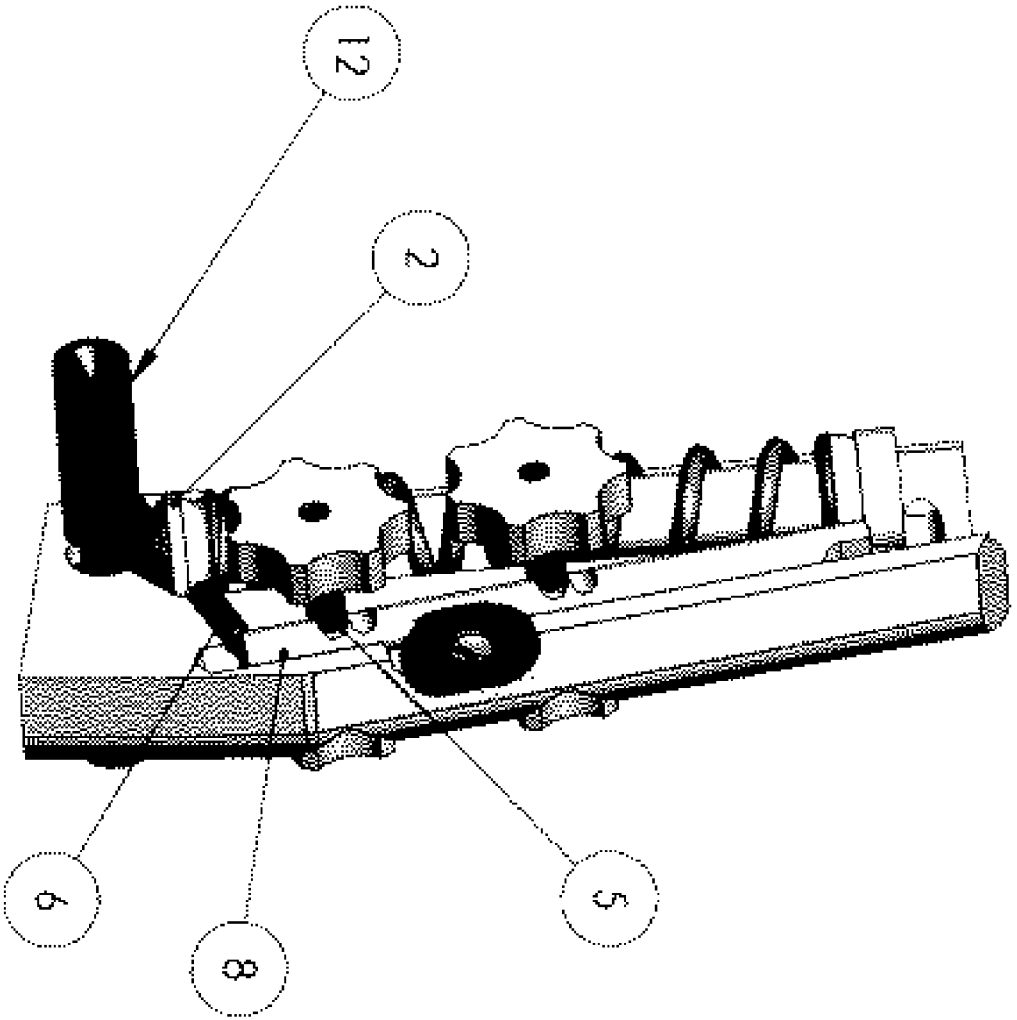
FIG. 5 is an oblique sectional view illustrating the operation of the locking device in accordance with the preferred embodiment.
Figure 6:
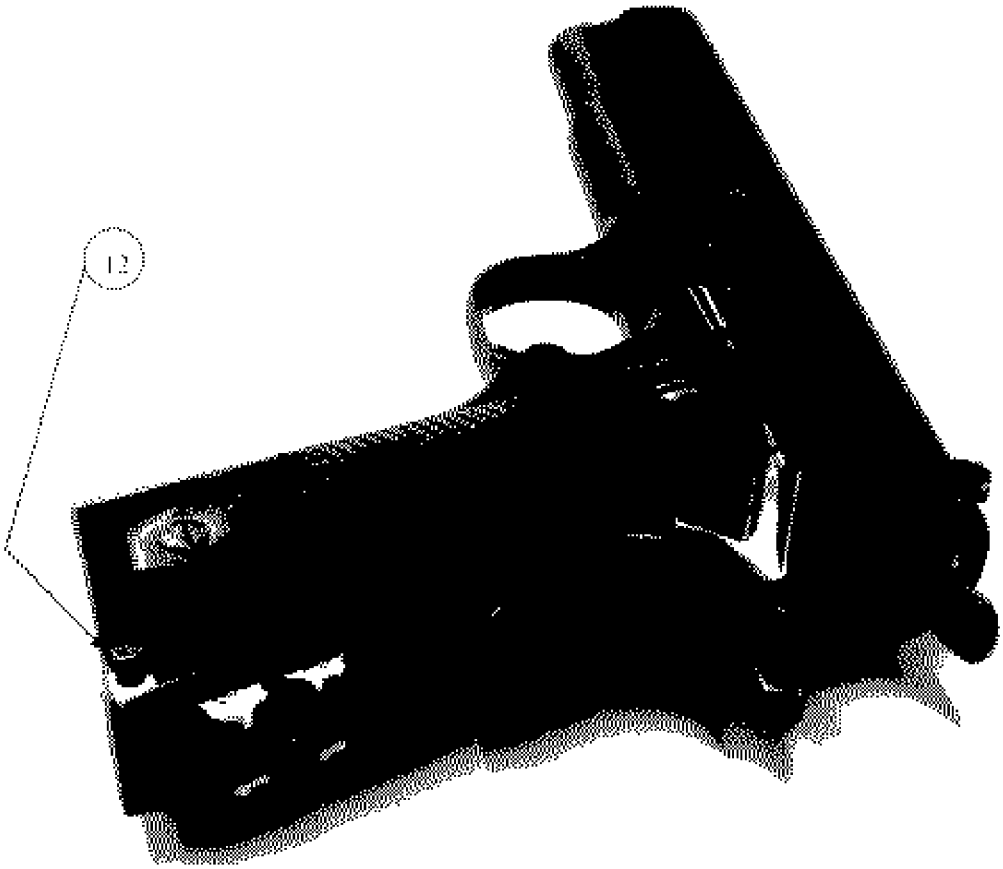
FIG. 6 is a rear perspective view indicating a mainspring housing pin in accordance with a preferred embodiment of the present invention.

FIGS. 3A and 3B depict the present safety lock unit in the unlocked position. The lock rod actuator 10 is joined to the lock rod 9 with the screw 6, so that a sliding displacement of actuator 10 allows the lock rod 9 to be displaced. The lock rod 9 is then retracted to allow a mainspring cap 3 to slide freely in the spring cylinder. This unlocked position also allows a dismantle lock pin 7 to slide into a notch at the bottom end of the lock rod 9. This allows mainspring retainer pin 2 to slide up and allow the mainspring housing pin 12 to be pushed out, as indicated in FIG. 5. This allows the entire replacement main spring housing 1 to be removed and the rest of the weapon to be disassembled.

Figure 4A:
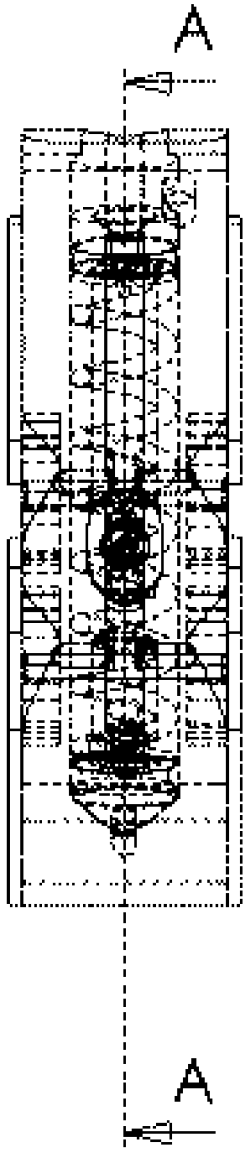
FIGS. 4A and 4B are respectively a front-detail view and a side-sectional view along line A-A showing the locking device (lock position) in accordance with the preferred embodiment.
Figure 4B:
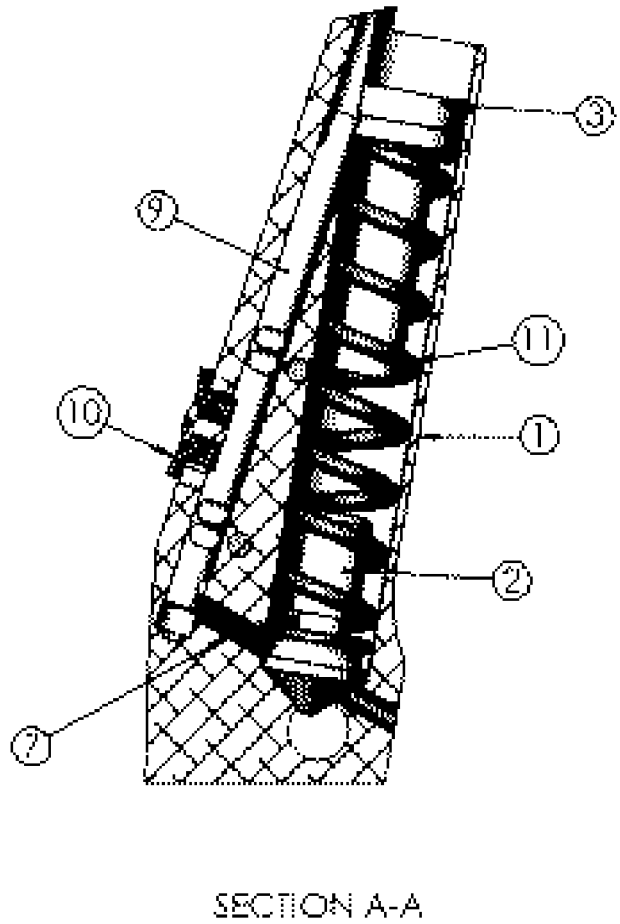

FIGS. 4A and 4B depict the present safety lock unit in the locked position, the lock rod 9 is again pushed up using the lock rod actuator 10. The lock rod 9 jams the mainspring cap 3, thereby preventing the compression of the main spring 11, so that the weapon cannot be fired. By locking the movement of the lock rod 9, the dismantle lock pin 7 is moved into a notch on the mainspring retainer pin 2 (as illustrated), thereby preventing the disassembly of the weapon.

FIG. 5 shows a safety locking unit mounted in an M1911 .45 caliber pistol. A mainspring housing pin 12 is locked in place by the retainer pin 2, which is in turn retained when the dismantle lock pin 7 is received in the notch on the retainer pin 2, which itself is held in place by the lock rod 9 when the safety lock is in the locked position.

As described hereinabove, the presently disclosed embodiments solve many problems associated with previous type solutions. However, it will be appreciated that various changes in the details, materials, arrangements of parts and other suitable variations as have been herein-described and illustrated in order to explain the nature of the present embodiments may be made by those skilled in the area within the principle and scope of this disclosure, and will be expressed in the appended claims.

We claim:

1. A locking device for a mainspring housing in a firearm comprising:

said mainspring housing, comprising an internal cylindrical portion for receiving a firing spring;

a lock rod, received in a main housing, for selectively engaging the firing spring, the lock rod movable between an engagement position and a disengagement position with the firing spring;

at least two combination disks for engaging the lock rod, to selectively fix the lock rod in one of the engagement position and the disengagement position;

wherein each combination disk cooperates with a respective disk pin, each disk pin having a proximal end for engaging a respective notch on the lock rod and a distal end for engaging a depression on an interior surface of the respective combination disk, wherein engagement of the proximal end of said each disk pin with the respective notch retains the lock pin, and engagement of the distal end of each lock pin with the respective depression allows movement of the proximal end out of the notch, releasing the lock pin.

2. The locking device of claim 1, wherein the at least two combination disks each comprise a plurality of combination disks for each engaging the lock rod.

3. The locking device of claim 1, wherein each notch comprises a first notch and a second notch, wherein engagement of the proximal end of one said disk pin with the first notch fixes the lock rod in the engagement position and engagement of the proximal end of the same one said disk pin with the second notch fixes the lock rod in the disengagement position.

4. The locking device of claim 1, wherein each combination disk is rotatable such that the depression on each combination disk is rotatably aligned to receive the distal end of the respective disk pin.

5. The locking device of claim 1, wherein the lock rod engages a dismantling pin which engages a mainspring retainer pin to keep the firearm from being disassembled.

* * * * *